United States Patent [19]

Ryss et al.

[11] 3,930,842

[45] Jan. 6, 1976

[54] METHOD OF PRODUCING ALLOYS BASED ON CALCIUM, SILICON AND IRON

[76] Inventors: Mark Abramovich Ryss, ulitsa Rossiiskaya, 32, kv. 2; Viktor Petrovich Zaiko, ulitsa Rossiiskaya, 63, kv. 135, both of, Chelyabinsk; Gerald Semenovich Belyaev, ulitsa 9 Gvardeiskoi divizii, 52, kv. 67, Istra Moskovskoi oblasti; Anatoly Konstantinovich Golev, prospekt Lenina, 71, kv. 111, Chelyabinsk; Aron Semenovich Mikulinsky, ulitsa Bosova, 1, kv. 54, Istra Moskovskoi oblasti; Vladimir Nikolaevich Gusarov, ulitsa Rossiiskaya, 32, kv. 3, Chelyabinsk; Stepan Evgenievich Pigasov, ulitsa Rosiiskaya, 32, kv. 20, Chelyabinsk; Igor Sergeevich Bedov, ulitsa Rossiiskaya, 57, kv. 28, Chelyabinsk; Valentin Nikotovich Pomogaev, ulitsa Rossiiskaya, 59, kv. 9, Chelyabinsk; Georgy Nikolaevich Kozhevnikov, ulitsa Malysheva, 107, korpus 1, kv. 40, Sverdlovsk, all of U.S.S.R.

[22] Filed: Aug. 20, 1974

[21] Appl. No.: 499,084

Related U.S. Application Data

[63] Continuation of Ser. No. 390,219, Aug. 21, 1973, abandoned.

[52] U.S. Cl. ..... 75/10 R; 75/129

[51] Int. Cl.[2] ..... C22D 7/06

[58] Field of Search ..... 75/10, 27, 129, 134 S

[56] References Cited

UNITED STATES PATENTS

| | | | |
|---|---|---|---|
| 2,194,965 | 3/1940 | Andrieux | 75/27 |
| 3,256,087 | 6/1966 | Pfluger | 75/134 S |
| 3,475,162 | 10/1969 | Rhodes et al. | 75/10 R |

FOREIGN PATENTS OR APPLICATIONS

| | | | |
|---|---|---|---|
| 933,393 | 8/1963 | United Kingdom | 75/134 S |

*Primary Examiner*—M. J. Andrews
*Attorney, Agent, or Firm*—Holman & Stern

[57] ABSTRACT

A method of making an alloy of calcium, silicon and iron in which a batch is charged into an electric furnace in portions and melted in a reducing atmosphere, with the loading of the first batch portion consisting entirely of lime being started during the period of discharging the melt of the previous melting, and with the last batch portion amounting to from 3–30 wt.% of the quantity of the melt present in the furnace being loaded 10–30 minutes before the melt is discharged from the furnace.

8 Claims, No Drawings

METHOD OF PRODUCING ALLOYS BASED ON CALCIUM, SILICON AND IRON

This is a continuation of application Ser. No. 390,219, filed Aug. 21, 1973, now abandoned.

The present invention relates to the metallurgical industry and in particular to methods of producing calcium-containing alloys used for deoxidation, modification as well as for alloying non-ferrous and ferrous metals.

More particularly, the present invention relates to methods of producing alloys based on calcium, silicon and iron. Alloys comprising calcium, silicon and iron have a number of advantages over silicocalcium, which consists chiefly of calcium and silicon, as they are more dense, better assimilated by the metal being processed, and contain markedly less detrimental admixtures such as sulphur, phosphorus and carbon. The process of melting when alloys based on calcium, silicon and iron are produced is uncomparably more liable to mechanization and to automatic control than the process of melting in the production of silicocalcium by the carbothermal method.

As calcium is the basic component of the alloy and at the same time the most low-melting and volatile element, any method of producing calcium-containing alloys by means of a reducing lime with any reducing agent should be performed in such a way that the degree of calcium volatilization is lowered to a minimum. When silicon and alloys thereof are used as the reducing agent, another requirement is imposed on the methods of producing calcium-containing alloys, viz. the necessity to increase as much as possible the degree of silicon utilization as silicon and its alloys are very costly and power-consuming products. Taking into consideration that calcium fluoride and other deficit products are used as fluxes in the production of calcium-containing alloys, a minimum amount of the fluxes should be employed in the process. As the process of producing calcium-containing alloys, and in particular alloys based on calcium, silicon and iron is performed in electric furnaces it is necessary to bring to a minimum the consumption of electric energy per unit of the product melted.

As the alloys based on calcium, silicon and iron are used for deoxidation and for alloying diverse metals, i.e. at the last stage of producing metals prior to the solidification of the casting, these alloys must contain a possibly minimum amount of nonmetallics and other detrimental admixtures. Therefore the technology involved in the production of such alloys must be arranged so as to eliminate the possibility of contaminating the alloys with said detrimental inclusions and admixtures.

A method of melting alloys based on calcium, silicon and iron from lime, fluorite and ferrosilicon in an electric arc furnace is known which comprises charging the batch and gradually, melting the same, followed by discharging the melt from the furnace.

This known method of producing alloys based on calcium, silicon and iron has a number of substantial disadvantages lowering the process efficiency. The principal disadvantages are, as follows:

Due to the reaction of the melt with air oxygen, moisture introduced with the batch materials, and with carbon dioxide being evolved through the decomposition of carbonates which are always present in lime and fluorite, the oxidation of the previously reduced calcium and silicon occurs which lowers the degree of utilization of these elements in the process, thus adversely affecting all the technical and economic factors and increasing the consumption of the silicon-containing reducer, fluxes, and electric energy.

When such technology is employed, a sufficiently complete separation of the metal from the slag cannot be attained, which leads to the contamination of the alloy having slime inclusions.

An object of the present invention is the melting of alloys based on calcium, silicon and iron by a method which makes it possible to reduce the expenditure of raw materials (batch materials) and electric energy.

Another object of the present invention is to provide a method making it possible to melt out an alloy based on calcium, silicon and iron, containing a minimum amount of detrimental admixtures viz. sulphur, phosphorus, carbon, non-metallics and slag inclusions.

Still another object of the present invention is to provide a method which makes it possible to melt out an alloy based on calcium, silicon and iron possessing an increased density.

These objects have been accomplished by charging, in portions, a batch incorporating lime, a silicon-containing reducer, and fluxes into an electric furnace, followed by melting said batch and discharging the melt from the furance, and, according to the invention, the charge of the first portion of the batch consisting of lime going into the electric furnace is stated at the time when the melt of the previous melting is being discharged with the last portion of the batch in an amount of from 3–30% of the weight of the melt present in the furnace being charged from 10–30 minutes before the discharge of the melt from the furnace is started, and with the melting of the batch charged being performed in a reducing atmosphere.

A modification of the present invention consists in that the first portion of the batch contains lime and fluxes.

The present method makes it possible to prevent oxidation of the calcium and silicon in the production of alloys based on calcium, silicon and iron and, hence, reduces the consumption of electric power and the batch materials. Thus, specific electric energy consumption per ton of the alloy (15% of calcium) is decreased by 1000 kwhr.

At the same time the consumption of lime and calcium fluoride has decreased and the productivity of the furnace unit has increased.

As the process of melting is more intensive, a better slag separation from the alloy takes place. The alloy is essentially free of slag and non-metallics, and the sulphur and phosphorus contents are 0.001% and 0.02–0.01% respectively.

It is expedient for the last portion of the batch charged to the furnace to comprise an aluminum-containing alloy.

The present method of producing alloys based on calcium, silicon and iron makes it possible to lower the temperature of the process of producing the alloy, and, hence, to increase the content of calcium in the alloy at the cost of a decrease in silicon content, which, in turn, makes it possible to increase the density of the alloy obtained by from 0.5–1 g/cm$^3$ and produce an alloy having a density of from 3.5–4.5 g/cm$^3$.

The alloy having an increased density can be more effectively used in working ferrous and non-ferrous metals and alloys, particularly, in working steel.

Another modification of the present invention consists in that the last portion of the batch charged to the furnace contains an alloy material.

The introduction of an alloying material with the last portion of the batch makes it possible to produce multicomponent alloys based on calcium, silicon and iron without adversely affecting the technical and economic factors of the process of producing said alloys. Besides the introduction of said material into the last portion of the batch makes it possible to also increase the density of the alloy obtained without lowering the calcium content therein.

In accordance with the present invention, it is advantageous to employ a batch whose particle sizes are less than 20 mm, which makes it possible to intensify the melting process, increase productivity of the furnace and reduce the consumption of the raw materials and electric energy.

In addition, it is advisable that the silicon-containing reducer forming a part of the batch composition contains from 60–70% of silicon.

The use of the silicon-containing reducer with a 60–70% silicon content makes it possible to raise the density of the alloy, to decrease the action of the electric arc on the alloy and to improve the conditions for separating the metal from the slag in the process of teeming.

At the same time the calcium content in the alloy does not decrease and may range from 15 to 25% and be even higher.

It is expedient for the lime, incorporated in the batch composition, to be preliminarily calcined at a temperature of from 1400°–1800°C.

The use of lime calcined at a temperature of 1400°–1800°C makes it practically possible to completely obviate the possibility of penetrating the calcium carbonates and the hydroxides into the melt and, hence, to prevent oxidation of the alloy with water vapours and carbon dioxide in the furnace.

Another modification of the present invention consists in that a reducing atmosphere is created in the furnace, during the period of melting the batch, by introducing carbon-containing materials into the furnace zone where the temperature is above 1800°C.

The introduction of the carbon-containing materials into the furnace zone where the temperature is above 1800°C makes it possible to intensify the process of hydrogen, carbon monoxide and hydrocarbons formation and to provide for a protective atmosphere in the furnace consisting of these gases. Thus, the oxidation of the previously reduced calcium and silicon is, practically, completely obviated.

Other objects and advantages of the present invention will become apparent from the following detailed description of the present method of producing alloys based on calcium, silicon and iron.

The present method of producing alloys based on calcium, silicon and iron provides for a continuous operation for the furnace in which the continuous melting is effected.

The batch may be charged into the furance both continuously and batchwise. However at the beginning and at the end of the melting, the batch must have quite the definite composition as is described hereinbelow.

According to the invention, during the period of discharging the melt from the furnace the charging of the furnace with a definite batch portion referred to as "first portion" is started. "The first portion" consists of lime preliminarily calcined at a temperature of 1400°–1800°C and having a particle size of 20 mm. It is necessary to mention that the lime incorporated in the composition of the following batch portions is also subjected to said heat treatment. We propose to calcine the lime preliminarily as this provides for a reduction in the quantity of carbon dioxide compounds in the lime which further results in lowering the oxidation of calcium during the period of melting. Besides, the total batch charged into the furnace has a particle size less than 20 mm which accounts for a high rate in the reduction processes, the latter being conducive to a more complete utilization of calcium and silicon in the alloy.

The introduction of the "first portion" of the batch consisting of lime and, possibly, of fluxes leads to accelerating slag formation and, hence, to preventing the oxidation of calcium, silicon and other elements present in the alloy.

Lime must be charged just at the time of discharging the melt as this makes it possible to accelerate the melting process, to attain a steady current load in the starting period of melting and to provide conditions for the continuous passage of one melting to another. It is advantageous to use lime for the first portion as lime is the basic slag-forming element. Along with the lime it is advisable to introduce fluxes during this period which makes it possible to accelerate the slag formation process to a still greater degree.

After the first portion of the batch is charged into the furnace, subsequent portions are charged consisting of lime, a silicon-containing reducer such as ferrosilicon or ferrosilicoaluminium or other alloys having a silicon content of above 50% and fluxes, e.g. materials containing fluorine compounds of calcium or magnesium or of other elements. Chlorides, oxides and sulphides may also the used as fluxes, calcium fluoride being the most preferable flux.

Subsequent portions of the batch may be charged either immediately after charging the first portion or with some intervals depending on the composition of the batch used and the quantity of the slag in the furnace. From 10–30 minutes before the beginning of the discharge of the melt from the furnace, i.e. 10–30 minutes prior to the completion of melting, the last portion of the batch material is charged into the furnace.

The last portion of the batch is charged not earlier than 30 minutes before the beginning of the discharge of the melt, for if the batch is charged earlier, than overheating of the melt occurs which results in the evaporation of calcium and other elements from the metal.

However, charging the last batch portion less than 10 minutes before the beginning of the discharge of the melt from the furnace is not advisable, as the batch obtained, in this case, either does not have time enough to separate to a sufficient extent from the slag to settle or there is not enough time for the batch to melt completely. It is thus necessary to mention that the last batch portion must constitute from 3 to 30% by weight of the quantity of the melt present in the furnace at the time of charging the last portion.

It has been found that if the last batch portion constitutes less than 3% by weight, a slight reduction of calcium from the slag melt occurs and the alloy obtained contains a reduced amount of calcium.

In case the last portion of the batch exceeds 30% of the weight of the melt in the furnace, the silicon-containing reducer does not completely react with the slag melt and a part of said reducer passes uselessly to metal without being reacted with the calcium of the slag melt.

The aluminium containing alloy, e.g. ferroaluminium, ferrosilicoaluminium or other alloys containing aluminium is introduced into the composition of the last portion of the batch. As the aluminium possesses a higher affinity to oxygen than does silicon, the introduction of aluminium or alloys thereof during the last period of melting makes it possible to more completely reduce the calcium from the slag melt and, hence, to increase the calcium content in the alloy without increasing the silicon content therein.

The last portion of the batch charged into the furnace may contain an alloying material (alloy) incorporating such elements as chromium, manganese, molybdenum, tungsten, titanium, niobium, zirconium and the like. However, the alloying material being incorporated must not contain over 50% of silicon as otherwise the alloy obtained will contain an undesirable excess of silicon; besides, a high content of silicon in the alloy results in that said alloy will become lighter than the slag melt and float on the surface of the slag and be subjected to the action of the electric arc.

It is advisable to introduce not over 50% by weight of the alloying material into the last portion of the batch as an increase of said amount leads to displacement of calcium from the melt with the subsequent oxidation thereof.

The melting of the batch charged into the furnace is effected in a reducing atmosphere which is provided by the introduction of carbon-containing materials into the furnace zone where the temperature is above 1800°C.

As the carbon-containing material, coke, coal, natural gas, graphite, etc. may be used.

We have found that by introducing carbon-containing materials into the furnace zone where the temperature is over 1800°C, i.e. chiefly, into the zone close to the electrodes, it makes it possible to intensify the process of formation of hydrogen, carbon monoxide, and hydrocarbons and thus provides a protective atmosphere consisting of these gases in the furnace.

As a result, the oxidation of the previously reduced calcium and silicon is, in practice, completely obviated, which leads to a decrease in the raw materials and the electric energy consumption and to an increase of the furnace unit productivity.

The examples of the accomplishment of the present method are set forth hereinafter.

EXAMPLE 1

A three-phase arc furnace, covered with a roof of chromium-magnesite brick, and a capacity — 2000 kwhr, is charged with the batch portions consisting of lime, which is preliminarily calcined at a temperature of 1400°C and containing 97.3% of calcium oxide and 3.7% of other admixtures (silicon oxide, ferric oxide, aluminium oxide, sulphur, phosphorus, carbon dioxide), a flux containing 97% of calcium fluoride and 3.0% of other admixtures and a silicon-containing reducer, viz. granulated ferrosilicon with a 65% silicon content (32% of iron, 1.7% of calcium, 2% of aluminium, 0.001% of sulphur, 0.04% of phosphorus and 0.01% of carbon). Prior to being charged into the furnace, all the batch materials are ground to a particle size of less than 20 mm.

The batch is charged in portions. The charging of the first portion of the batch into the furnace in an amount of 900 kg and consisting of lime of the aforementioned composition is started during the discharge of the melt (metal and slag) formed in the previous melting.

Lime is chiefly charged close to walls of the furnace and to the electrodes.

A constant electric regime is maintained in this period as well as in other periods of the melting. (voltage - 120 v, current intensity - 8000 *a*).

The second and the subsequent portions, except the last portion, of the batch, consist of lime - 200 kg
ferrosilicon - 180 kg
fluorite - 30 kg which are charged gradually while their melting is effected. 10 such portions are charged altogether during the entire melting cycle. Simultaneously, through the nozzle positioned near the electrode, natural gas is fed into the furnace in an amount which provides a gauge pressure of 1.3 mm water column in the furnace. The natural gas is fed directly into the arc burning zone where the temperature exceeds 1800°C which provides a reducing atmosphere in the furnace.

10 minutes before the beginning of melt discharge, a batch having the following composition is loaded into the furnace:

Lime - 30 kg
alumina - 20 kg
silicoaluminium - 100 kg (aluminium - 65% and silicon - 35%), which amounts to 3% of the quantity of the melt in the furnace.

EXAMPLE 2

A three-phase arc furnace, covered with a roof of magnesite brick, having a capacity of 5000 kwhr, is charged with a batch in portions consisting of lime preliminarily calcined at a temperature of 1800°C and containing 95% of calcium oxide and 5% of other admixtures, fluxes, viz. calcium fluoride and alumina containing, 97% of calcium fluoride and 98% of aluminium oxide respectively, and a silicon-containing reducer, viz. an alloy of the following composition: 70% of silicon, 3% of aluminium and 27% of iron. All the batch materials are crushed in a crusher to a particle size of less than 20 mm.

The charging of the batch is effected in the following manner.

The charging of the first portion of the batch into the furnace in an amount of 2500 kg and consisting of lime is started during the discharge of the melt formed in the previous melting.

Lime is chiefly charged close to the walls of the furnace.

The second and the subsequent portions, except the last one, are charged in three steps approximately in equal parts, and consisting of lime - 1600 kg
siliceous alloy - 1200 kg
(Si - 70%, Al - 3% and Fe - 27%) - 160 kg Finely ground carbon coke is simultaneously fed into the furnace.

The coke is fed through a nozzle with the help of an inert gas directly into the arc burning zone, where the temperature exceeds 1800°C, which makes it possible to maintain a reducing atmosphere in the furnace and prevents the oxidation of calcium and silicon.

30 minutes before the beginning of the melt discharge, a batch of the following composition is loaded into the furnace:

silicochromium (silicon - 50%, chromium - 25%, iron - 25%) 600 kg, and calcium fluoride - 400 kg, which amounts to 30% of the quantity of the melt in the furnace.

What we claim is:

1. In a method for continuously producing calcium-silicon-iron alloys comprising the steps of: charging batches into an electric furnace and under a reducing atmosphere, each of the batches comprising lime, silicon-containing reducing agents and fluxes and being introduced in at least three portions; melting the at least three portions of one of the batches to form a melt consisting of a calcium-silicon-iron alloy and slag; and pouring the melt from the furnace prior to charging another one of the batches; the improvement comprising the steps of: charging a first portion consisting of lime and fluxes of each of the batches while pouring the melt formed from a previous batch from the furnace; charging at least one portion consisting of lime, the silicon-containing reducing agents and the fluxes of each of the batches after pouring the melt from a previous batch from the furnace; and charging a last portion of each of the batches during a period of 10 to 30 minutes prior to beginning the pouring of the melt from the furnace, the last portion comprising from 3 to 30% by weight of the melt prior to pouring.

2. In a method for continuously producing calcium-silicon-iron alloys comprising the steps of: charging batches into an electric furnace and under a reducing atmosphere, each of the batches comprising lime, silicon-containing reducing agents and fluxes and being introduced in at least three portions; melting the at least three portions of one of the batches to form a melt consisting of a calcium-silicon-iron alloy and slag; and pouring the melt from the furnace prior to charging another one of the batches; the improvement comprising the steps of: charging a first portion consisting of lime of each of the batches while pouring the melt formed from a previous batch from the furnace; charging at least one portion consisting of lime, the silicon-containing reducing agents and the fluxes of each of the batches after pouring the melt from a previous batch from the furnace; and charging a last portion of each of the batches during a period of 10 to 30 minutes prior to beginning the pouring of the melt from the furnace, the last portion comprising from 3 to 30% by weight of the melt prior to pouring.

3. The method of producing alloys based on calcium, silicon and iron as claimed in claim 2, wherein the last portion of each of the batches charged into the furnace contains an aluminum-containing alloy.

4. The method of producing alloys based on calcium, silicon and iron as claimed in claim 2, wherein the last portion of each of the batches charged into the furnace contains an alloying material.

5. The method of producing alloys based on calcium, silicon and iron as claimed in claim 2, wherein batch materials having a particle size of less than 20 mm are used.

6. The method of producing alloys based on calcium, silicon and iron as claimed in claim 2, wherein the silicon-containing reducing agents contains from 60–70% of silicon.

7. The method of producing alloys based on calcium, silicon and iron as claimed in claim 2, wherein the lime is preliminarily calcined at a temperature of 1400°–1800°C.

8. The method of producing alloys based on calcium, silicon and iron as claimed in claim 2, wherein the reducing atmosphere in the furnace is provided by introducing carbon-containing materials into a furnace zone where the temperature exceeds 1800°C.

* * * * *